United States Patent [19]

Whitley et al.

[11] 4,257,484

[45] Mar. 24, 1981

[54] PRESSURE DIFFERENTIAL CIRCULATING VALVE

[76] Inventors: Oran D. Whitley, 1506 N. Colpitts; James B. Pogue, Rte. 1, Box 78-A, both of Ft. Stockton, Tex.

[21] Appl. No.: 128,993

[22] Filed: Mar. 10, 1980

[51] Int. Cl.[3] ..... G05D 11/03

[52] U.S. Cl. ..... 166/325; 166/321; 137/115

[58] Field of Search ..... 137/508, 115, 116, 538; 166/319, 321, 325

[56] References Cited

U.S. PATENT DOCUMENTS

| | | | |
|---|---|---|---|
| 2,128,352 | 8/1938 | Creighton | 166/325 |
| 2,211,846 | 8/1940 | Brown | 166/325 |
| 2,488,649 | 11/1949 | Teague, Jr. | 137/508 |
| 2,855,952 | 10/1958 | Tausch et al. | 137/508 |
| 3,376,936 | 4/1968 | Tomlin | 166/304 |
| 3,500,911 | 3/1970 | Farley et al. | 166/315 |
| 3,542,130 | 11/1970 | Stout | 166/304 |
| 3,750,749 | 8/1973 | Giroux | 166/321 |
| 4,049,057 | 9/1977 | Hewes | 166/312 |

*Primary Examiner*—Martin P. Schwadron
*Assistant Examiner*—H. Jay Spiegel
*Attorney, Agent, or Firm*—Jamese F. Weiler; Dudley R. Dobie, Jr.; William A. Stout

[57] ABSTRACT

Disclosed is a pressure differential circulating valve which can be connected to and form a portion of the tubing string disposed in casing for flow of fluid from a formation traversed by the casing and the tubing. Advantageously, the pressure differential circulating valve has an unrestricted passageway of substantially the same size and shape as that of the tubing string, yet is small enough in external diameter to be disposed in normal casing set in a well bore, can be set to open at any flow pressure and can be placed at any depth. Thus, in pumping fluids down the tubing, such as hot oil to remove paraffin from the inside of the tubing and pump rods and the like, or other treating fluids, such as to treat corrosion problems, the pressure differential circulating valve opens at the predetermined pressure permitting flow of fluid therethrough into the annulus between the casing and the tubing string. The pressure differential circulating valve automatically closes when the flow pressure drops to below the predetermined pressure, such as normal flow pressures. Also, if the flow line from the well becomes plugged, or in the event of human error in closing a valve and there is a buildup of flow pressure in the tubing string and hence in the pressure differential circulating valve, it will open and circulate fluid in the annulus until the problem is corrected.

11 Claims, 2 Drawing Figures

32
12
10
72
30
12
40
34
38
36

14
48
52
65
62
68
10
42
28
64
18
44
66
60
59
58
60
61
54
56
50
63
46
16

PRESSURE DIFFERENTIAL CIRCULATING VALVE

BACKGROUND OF THE INVENTION

There have been a number of proposals for providing bypass or circulating valves for use in oil wells. For example, U.S. Pat. No. 3,500,911 discloses a device which has an internally mounted valve sleeve 50 which opens and uncovers the port 64 while the string is being run to the depth of the formation in response to the hydrostatic pressure of the well fluid. The valve 50 closes when the pressure reaches a certain minimum value and is for use with packers for open hole drill stem testing of wells.

U.S. Pat. No. 3,542,130 discloses a valve for removing paraffin from oil wells in which there is a spring loaded sleeve with a restriction in the sleeve that is used to hold a wax plug to close off the sleeve allowing it to move downwardly so that hot oil may pass out through the port 68. The hot oil dissolves wax in the string and flows back up through the pipe and carries the then melted wax plug along with the paraffin in the well to the surface.

U.S. Pat. No. 4,049,057 discloses a paraffin cleaner in which there are valves in a unit, which does have an unrestricted passage through it but the unit is eccentrically mounted, utilizes cupped or Belville washers, and does not circulate treating fluid out of the cleaner about a circumference of 360°.

U.S. Pat. No. 3,376,936 discloses a bypass for removing paraffin in which a sliding sleeve arrangement is operated from the surface to uncover ports to allow the hot oil to pass out of the oil string.

None of the foregoing patents, however, discloses a pressure differential circulating valve which becomes an integral part of the tubing string, is of small enough external diameter so that it can be readily disposed in a normal casing string in the well bore and yet have an unrestricted passageway through it of substantially the same size and shape as the tubing string, which can be set to open at any desired pressure, and which is opened by applying flow pressure to the tubing, such as from the surface, so that fluid, such as hot oil or other treating fluid, can circulate down through the tubing and out 360° through the pressure differential circulating valve, and when the treatment is completed, the pressure differential circulating valve automatically closes for resumption of normal operations, such as pumping oil by sucker rods extending through the passageways in the tubing and in the pressure differential circulating tool to the surface.

SUMMARY OF THE INVENTION

The present invention is directed to such a pressure differential circulating valve.

In short, the pressure differential circulating valve comprises a tubular body having means at its ends for connection in and to form a portion of the tubing string, a passageway through it communicating with and forming an unrestricted portion of the tubing string passageway, an annular chamber disposed about the body, the annular chamber having an annular valve seat adjacent one end thereof, a tubular slide valve slidably disposed about the body in the annular chamber having an annular valve surface engagable with the valve seat, seal means associated with the body and the tubular slide valve effective to provide a seal between the body and the tubular slide valve, inner ports extending through and circumferentially about the body disposed between the valve seat and the seal means, spring means disposed in the annular chamber yieldingly maintaining the slide valve sleeve in a position so that the valve surface sets on the valve seat and closes the valve during normal flow pressures in the passageway but yieldable to predetermined flow pressure higher than normal flow pressure to unseat the valves, and outer ports extending through and circumferentially about the outer annular chamber body for flow of fluid out the circulating valve.

Thus, during normal flow through the passageways in the tubing string and through the pressure differential circulating valve, the tubular slide valve is closed by the valve surface sealingly engaging the valve seat and upon application of flow pressure in the passageways at a pressure higher than the normal flow pressure, fluid in the tubular body passageway flows through the inner ports at the base of the sliding valve and pushes the sliding valve away from the valve seat to unseat the valve surface from the valve seat and to uncover the inner ports and permit the flow of fluid from the passageway in the tubular body into the annular chamber and out the outer ports into the annular space between the casing and the tubing string. The compression spring automatically moves the slide valve to its closed position upon reduction of flow pressure to and below the normal flow pressure or its preset opening pressure.

The differential pressure circulating valve can be set to open at any predetermined pressure, one or more can be set at any depth and it can be used for treatment of the well to remove paraffin or to treat wells that pump below packers in the well, or can be used to circulate fluid through a 360° radius from within the tubing string into the annuar space between the tubing string and the casing for any purpose, such as treating corrosion. It becomes part of the tubing string, can be set at any depth, and it automatically closes upon completion of the treatment or in the event a flow line is plugged or there is human error in closing a valve, it will open and circulate downhole until the problem has been corrected.

The pressure circulating valve is made so that it can be readily assembled and disassembled for removal and repair or replacement of parts, if desired. Details of the pressure circulating valve are set forth subsequently herein.

Accordingly, it is an object of the present invention to provide a pressure differential circulating valve which can be connected into and become an integral part of a tubing string disposed within casing within a well bore, which has an unrestricted passageway through it of substantially the sam size and shape as that of the tubing string, and which can be set to open at any desired pressure to circulate fluid from within the tubing and pressure differential valve circulating passageways into the annular space between the casing and the tubing string and which automatically closes when the flow pressure within these passageways drops below the predetermined pressure.

A further object of the present invention is the provision of such a pressure differential circulating valve which does not interfere with normal production operations and through which oil and water can be pumped by pump or sucker rods extending from the surface.

A further object of the present invention is the provision of such a pressure differential circulating valve which does not interfere with normal production procedures and equipment.

A further object of the present invention is the provision of such a differential pressure circulating valve which can be set to open and to close at any desired pressure and which can be set in the tubing string at any depth.

Yet a further object of the present invention is the provision of such a pressure differential circulating valve which is readily assembled and disassembled for removal and repair or replacement of parts, as desired.

Yet a further object of the present invention is the provision of such a pressure differential circulating valve which can be utilized in pumping hot oil down the tubing string to remove paraffin from the rods and the tubing thus avoiding heating the casing, surface pipe, formation or causing damage to the cement bonding of the casing and in which a substantially reduced amount of hot oil is required to remove the paraffin from the rods and tubing.

Further object of the present invention is the provision of such a pressure differential circulating tool which can be utilized to treat wells that pump below packers packing off the annular space between the casing and the tubing above the formation being produced.

Yet a further object is the provision of such a pressure differential valve in which treating fluids can be circulated into the casing locally where needed, such as treating or preventing corrosion without having to circulate treating fluids in the annulas between the casing and the tubing for extended periods of time, thereby reducing the amount of treating fluids and well shut down time.

A further object of the present invention is the provision of such a pressure differential circulating valve which is opened by applying flow pressure to the tubing passageway to overcome the preset pressure closing the valve, and which valve automatically closes when the flow pressure is reduced below that of the preset pressure closing the valve, such as when an oil unit or pump shuts down.

A further object of the present invention is the provision of such a pressure differential circulating valve which will automatically open and circulate fluid in the annular space between the tubing passageway and the casing in the event a flow line from the well becomes plugged or in the event there is human error in closing a valve in the line from the well bore, and which will remain open until the problem has been corrected.

A further object of the present invention is the provision of such a pressure differential circulating valve which is relatively inexpensive to manufacture, which is relatively simple in construction and operation, which can be assembled and disassembled readily and easily, which is highly efficient in use, and which reduces time and expense in treating wells.

Other and further objects, features and advantages of the pressure differential circulating valve appear throughout.

DESCRIPTION OF PREFERRED EMBODIMENTS

Figure 1:
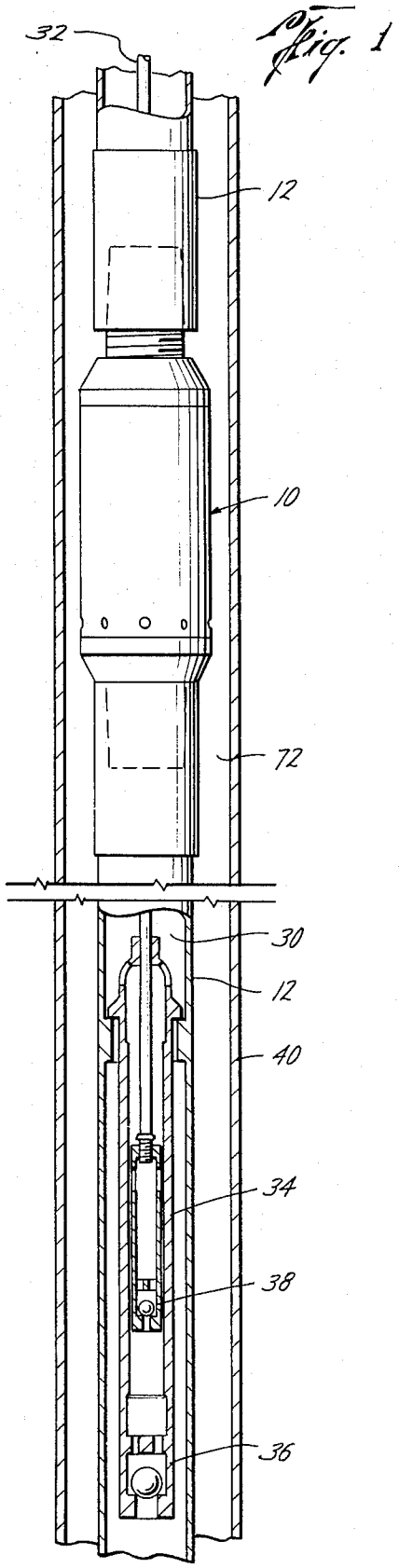
FIG. 1 is a side elevation, partly in section, illustrating the pressure circulating differential valve in position and forming part of a tubing in casing in a well bore having pumping (sucker) rods therein.
Figure 2:
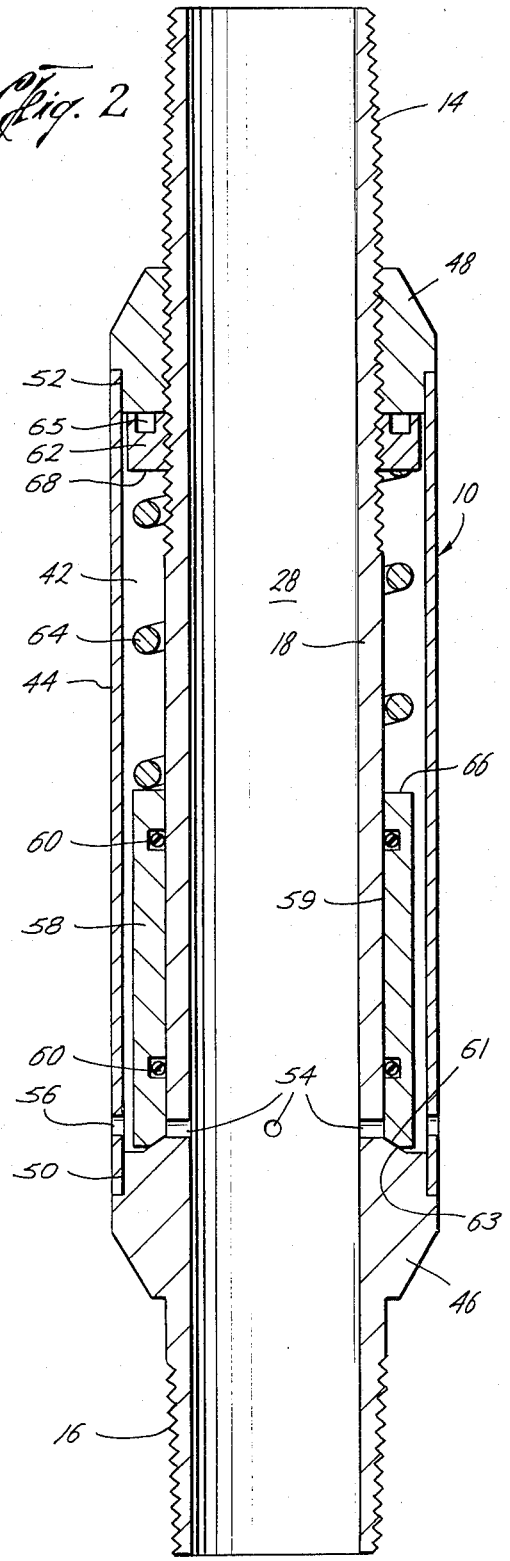
FIG. 2 is an enlarged sectional elevational view of the pressure differential circulating valve illustrated in FIG. 1.

Referring to the drawing, the pressure differential circulating valve is generally indicated by the reference numeral 10 and is shown connected in the tubing string 12 by the tubing threads 14 and 16 on the upper and lower ends of the tubular body 18, although the pressure differential circulating valve 10 can be connected into the tubing string by any desired means.

The passageway 28 is generally of the same internal diameter and shape of the passageway 30 in the tubing string 12 so that there is an unrestricted flow passage of generally the same size and shape through the pressure differential circulating valve 10 as in the tubing 12. Thus, pump or sucker rods 32 extending from pumping equipment at the surface (not shown) can readily extend through the passageway 28 in the pressure differential circulating valve 10 as well as the pump mechanism 34 attached to the pump rods, including the standing or backpressure valve 36 and the traveling valve 38 which can pass through and be secured in the tubing string to pump fluid from a well traveresed by the tubing 12 and the casing 40 in the normal manner without any interference whatsoever with the pumping operation.

No further description is given of the pumping equipment and rods as the pressure differential circulating valve 10 can be used in tubing strings with any desired type of pumping equipment, none of which constitutes the present invention.

An annular chamber 42 is disposed about the tubular body 18 of the pressure differential circulating valve 10, which annular chamber 42 preferably is formed by a tubular sleeve or body member 44 extending between the annular shoulder 46 at its lower end and the annular shoulder 48 at its upper end, which annular shoulder 48 is in the form of a threaded nut for ease of assembly and disassembly.

The annular shoulders 46 and 48 have reduced external diameter portions 50 and 52 in which ends of the tubular sleeve 44 are releasably secured.

The inner ports 54 extend through the lower portion of the tubular body 18 and provide fluid communication with the annular chamber 42 and outer ports 56 extend through the outer tubular sleeve 44 and provide fluid communication with the exterior of the pressure differential circulating valve 10, when the valve is open. The ports 54 and 56 are circumferentially spaced and provide flow through completely through a 360° radius.

A tubular slide valve 58 is disposed in the annular chamber 42 and has the seal means in the form of O-rings 60 associated with and in the outer surface 62 of the tubular sleeve 18 to provide a seal between the slide valve 58 and the outer surface 59 of the tubular body 18.

An annular lock ring 62 is threaded to the threads 14 at the upper end of the tubular body 18, and a coiled compression spring 64 is disposed between the upper end 66 of the valve sleeve 58 and the lower end 68 of the lock ring 62. The compression spring 64 can be preset at any desired pressure by construction of the spring and by the positon of the lock ring 62. For example, simply screwing the lock ring 62 towards the valve sleeve 58 causes more compression in the coiled compression spring 64 to preset a desired higher pressure. To assist in screwing the lock ring 62 to adjust the compression in the spring 64, the openings 65 are provided so that a tool having projections which fit therein, such as a spanner wrench not shown, can be used to screw the lock ring 62 to effect the desired compression in the spring 64.

The pressure differential circulating valve 10 can be assembled simply by placing the slide valve 58 into position, the coil spring 64 into position, and then the lock ring 62 threaded into position for a desired preset pressure of the coil spring. The outer tubular sleeve 44 is then inserted into place and then the upper annular shoulder 48 is threaded into position securing the outer sleeve 44 in position. In disassembling the tool for replacement and repairs, the procedure is simply reversed. To change the pressure setting on the coil or compression spring 64, the upper annular shoulder 48 is removed, the outer tubular sleeve 48 is removed and then the lock ring 62 is threaded either toward or away from the coil spring 64 to the desired preset position. The outer tubular sleeve 44 is then put back into position and the annular shoulder 48 is threaded into position.

In operation, the pressure differential circulating tool 10 is simply threaded into the tubing string 12 and becomes a part thereof as shown in FIG. 1. Any oil well equipment, such as the pumping equipment illustrated, can be passed through and operated through the pressure differential circulating valve 10, which can be passed through tubing. When it is desired to treat the well, such as removing paraffin from the sucker rods 32, hot oil is pumped down the passageway 30 in the tubing string 12 and when its flow pressure is sufficient to overcome the compression of the coil spring 64, such as 500 to 4000 p.s.i., the hot oil flows through the inner ports 54 in the tubular body 18 and between the valve surface 61 and valve seat 63 thereby causing the slide valve 58 to move away from the valve seat 63 until it uncovers the inner ports 54, which thus permits the hot oil to flow into the annular chamber 42 and through the outer ports 56 in the outer tubular sleeve 44. Thus, when used for removing paraffin deposits, hot oil with melted paraffin flows down the passageways 28 and 30, around the sucker or pump rods 32, melting the paraffin, which melted paraffin flows out into the annulus 72 between the casing 40 and the tubing string 12 with the hot oil. Once the treatment has been completed, the pump pressure from the surface, not shown, is stopped, thus reducing the internal pressure to below the preset pressure and thus permitting the valve slide 58 to be moved toward the valve seat 63 by the compression in the coil spring 64 thereby closing the valve. Normal operations can then resume.

As previously mentioned, the pressure differential circulating valve 10 can be used for any purpose where it is desired to treat wells by circulating fluid from within the tubing string through the valve to the exterior of the tubing string for any desired purpose. Advantageously, the pressure differential circulating valve can be located at any depth in the tubing string, above or below packers packing off the annular space between the tubing and the casing for treatment by circulating fluids as indicated. The pressure differential circulating valve 10 simply opens at any predetermined, preset flow pressure and automatically closes when the pressure drops to below the preset pressure.

Advantageously, the treating fluids can be directed to the desired place or places in the tubing 12 and casing 40 without the time, expense and downtime of the well when circulating in the annulus between the tubing 12 and the casing 40 or circulating down and back in the tubing.

Also, use of the pressure differential circulating valve avoids heating the casing, surface pipe, formation or causing damage to the cement bonding of the casing and substantially reduced the amount of hot oil required, or other treating fluid than when circulating hot oil or other treating fluid in the tubing or annulus.

One or more of the pressure differential valves 10 can be used in the tubing 12, they can be set at the same or different preset opening pressures, and, if desired, the pressure circulating valve 10 can be reversed and connected upside down to that shown in the drawing.

While the pressure differential circulating valve has been described in connection with production of wells, it can also be used in drilling of wells, fishing and workover operations where it is desired to circulate fluid into a particular place in the well bore. It is only necessary to make the differential pressure circulating valve strong enough for the particular use and to fit into the drilling or workover string and to adjust the coil spring so that it will open at a desired preset pressure, such as above normal pump pressures for drilling fluids when drilling a well.

Accordingly, the pressure differential circulating valve is well suited and adapted to attain the objects and ends and has the advantages and features mentioned as well as others inherent therein.

While a preferred embodiment of the pressure differential circulating valve has been shown and described for purposes of disclosure, changes can be made and equivalents substituted therein in accordance with the spirit of the invention as defined by the appended claims.

What is claimed is:

1. A pressure differential circulating valve for use in a well having a casing and a tubing string therein for flow of fluid from a formation traversed thereby, the pressure differential circulating valve comprising, a tubular body having means at its ends for connection in and to form a portion of the tubing string, the body having a passageway therethrough communicating with and forming a portion of the tubing string passageway, a pair of facing annular shoulders extending outwardly of the body, an outer tubular body member disposed around the body and extending between the annular shoulders thereby providing an annular chamber between the body and the outer tubular sleeve, a tubular slide valve slidably disposed about the body in the annular chamber, seal means associated with the body and the tubular valve sleeve effective to provide a seal between the body and the tubular slide valve, inner ports in the body disposed between a first end of the valve sleeve and the seal means, a mating annular valve surface adjacent the one end of the slide valve and a mating annular valve seat outwardly of the inner ports, spring means disposed in the annular chamber yieldingly maintaining the slide valve in a position to sealingly close the annular valve surface against the annular valve seat thereby with the seal means closing the inner ports during normal flow pressures in the passageway in the tubular body but yieldable to predetermined flow pressure higher than the normal flow pressures, and outer ports in the outer tubular body member, whereby, during normal flow through the tubing string passageway and the passageway in the tubular body, the slide valve is closed thereby closing the inner ports, and upon application of flow pressure in the tubing passageway and the passageway in the tubular body at least as high as the predetermined flow pressure, fluid unseats the annular valve surface from the annular valve seat and forces the slide valve away from the annular valve seat uncovering the inner ports thereby permitting the flow of fluid from the passageway in the tubular body through the inner and outer ports into an annular space between the casing and the tubing string, the spring means moving the slide valve to its closed position upon reduction of flow pressure below the predetermined flow pressure thereby sealing the passageway in the tubular body.

2. The pressure differential circulating valve of claim 1 where, the passageway in the body is of substantially the same size and shape as the tubing string passageway.

3. The pressure differential circulating valve of claim 1 where, the means at the ends for connection to the tubing are tubing threads, and one of the pair of annular shoulders is threaded to the body and releasably secures the outer tubular body member so that it can be removed and replaced and thereby the slide valve and the spring means can be removed and replaced.

4. The pressure differential circulating valve of claim 1 where, the passageway in the body is of substantially the same size and shape as the tubing string passageway, the means at the ends of the tubular body for connection to the tubing are tubing threads, and one of the pair of annular shoulders is threaded to the body and releasably secures the outer tubular body member about the tubular body whereby the outer tubular body member can be removed and replaced and thereby the sliding valve and the spring means can be removed and replaced.

5. The pressure differential circulating valve of claim 1 where, the spring means comprises a compression spring bearing between one of the annular shoulders and a second end of the slide valve.

6. The pressure differential circulating valve of claim 1 where, the means at the ends of the tubular body for connection to the tubing are tubing threads, a lock ring is threadedly secured about the body in the annular space and inwardly of one of the pair of annular shoulders, the spring means comprises a compression spring bearing between the lock ring and a second end of the valve sleeve, movement of the lock ring adjusting compression of the compression spring, and the one of the pair of annular shoulders is threaded to the body and releasably secures the outer tubular body member to the annular shoulders whereby the outer tubular body member can be removed and replaced and thereby the lock ring, the compression spring and the slide valve can be removed and replaced.

7. The pressure differential circulating valve of claim 1 where, the passageway in the body is of substantially the same size and shape as the tubing string passageway, the means at the ends of the tubular body for connection to the tubing are tubing threads, a lock ring is threadedly secured about the body in the annular space and inwardly of one of the pair of annular shoulders, the spring means comprises a compression spring bearing between the lock ring and a second end of the valve sleeve, movement of the lock ring adjusting compression of the compression spring, and the one of the pair of annular shoulders is threaded to the body and releasably secures the outer tubular body member to the annular shoulders whereby the outer tubular body member can be removed and replaced and thereby the lock ring, the compression spring and the slide valve can be removed and replaced.

8. A pressure differential circulating valve for connection into and to form a portion of a string of pipe in a well bore comprising, a tubular body having means at its ends for connection in and to form the portion of the string of pipe, the body having an unrestricted passageway therethrough of substantially the same size and shape as that of the tubing string communicating with and forming a portion of the tubing string passageway, an annular chamber disposed exteriorly of the body and of an external size effective to permit disposition thereof within and spaced from walls of the well bore, a tubular slide valve slidably disposed about the body in the annular chamber, seal means associated with the body and the tubular slide valve effective to provide a seal between the body and the tubular slide valve, inner ports extending through the body disposed between a first end of the slide valve and the seal means, a mating annular valve surface adjacent the one end of the slide valve and a mating annular valve seat outwardly of the inner ports, spring means disposed in the annular chamber yieldingly maintaining the slide valve in a position to sealing close the annular valve surface against the annular valve seat thereby with the seal means closing the inner ports during normal flow pressures in the passageway in the tubular body but yieldable to predetermined flow pressure high than the normal flow pressures, and outer ports providing fluid communication between the annular chamber and the well bore, whereby during normal flow through the passageways in the string of pipe and in the tubular body, the slide valve is closed thereby closing the inner ports, and application of flow pressure in the passageways of the string of pipe and in the annular body at least as high as the predetermined flow pressure unseats the annular valve surface from the annular seat and forces the slide valve away from the annular seat uncovering the inner ports thereby permitting the flow of fluid from the passageway in the tubular body through the inner ports into the annular chamber and out the outer ports into the well bore, the spring means forcing the slide valve to its closed position upon reduction of flow pressure below the predetermined flow pressure thereby sealing the passageway in the tubular body.

9. The pressure differential circulating valve of claim 8 where, the means at the ends for connection to the string of pipe are pipe threads.

10. The pressure differential circulating valve of claim 8 where, the inner and outer ports are disposed circumferentially around a 360° radius.

11. The pressure differential circulating valve of claim 8 where, the mating annular valve surface and seat are beveled.

* * * * *